US005359955A

United States Patent [19]

Grebenyuk

[11] Patent Number: 5,359,955

[45] Date of Patent: Nov. 1, 1994

[54] SPILL PALLET WITH IMPROVED LOAD BEARING CAPABILITY

[75] Inventor: Alexander Grebenyuk, Williamsfield, Ohio

[73] Assignee: Enpac Corporation, Chardon, Ohio

[21] Appl. No.: 93,089

[22] Filed: Jul. 16, 1993

[51] Int. Cl.[5] ..... B65D 19/00

[52] U.S. Cl. ..... 108/51.1

[58] Field of Search ..... 108/51.1, 53.1, 53.3, 108/53.5, 55.3, 901, 902

[56] References Cited

U.S. PATENT DOCUMENTS

| | | | |
|---|---|---|---|
| 3,140,672 | 7/1964 | DeLuca | 108/55.3 X |
| 4,263,855 | 4/1981 | Lawlor | 108/55.3 X |
| 4,361,232 | 11/1982 | Olmsted . | |
| 4,580,680 | 4/1986 | Wind | 108/55.3 X |
| 4,838,178 | 6/1989 | Chriske et al. | 108/51.1 X |
| 5,020,667 | 6/1991 | Bush | 100/51.1 X |
| 5,036,976 | 8/1991 | Sechler et al. | 100/51.1 X |
| 5,042,396 | 8/1991 | Shuert | 108/51.1 |
| 5,142,994 | 9/1992 | Sandberg et al. | 108/51.1 X |
| 5,144,897 | 9/1992 | Avery | 108/55.3 |
| 5,249,699 | 10/1993 | Williams | 108/51.1 |

*Primary Examiner*—Jose V. Chen

*Attorney, Agent, or Firm*—Pearne, Gordon, McCoy & Granger

[57] ABSTRACT

An improved spill pallet for the support of drums which contain hazardous material. The pallet provides a support surface which vertically abuts a grate upon which a number of drums are placed. Beneath the support surface is provided a number of bowl-shaped chambers which receive and contain spilled or leaked liquid. The support surface includes a peripheral rim, a series of support rails, and a central support member. The rails extend from a side wall of the pallet inwardly toward the central support member, a space or gap separating an inner terminal end of the rails and the central support member. Adjacent bowl-shaped chambers are fluidly connected by channels defined by the space between the terminal end of each rail and the central support member. The channels increase the volume available for retention and containment of liquid to at least two times the maximum volume of any drum or container placed on the pallet while the rails laterally support the side walls and help prevent deformation thereof.

9 Claims, 3 Drawing Sheets

SPILL PALLET WITH IMPROVED LOAD BEARING CAPABILITY

BACKGROUND OF THE INVENTION

1. Field of the Invention

The present invention generally relates to pallets and, more particularly, to spill pallets which support liquid containing drums and are capable of retaining spilled or leaked liquid from such drums.

2. Description of the Related Art

Spill pallets have developed in accordance with guidelines of the United States Environmental Protection Agency (EPA), and are designed to support one or more drums and to provide a reservoir to contain liquid should it escape or leak from the drums. The EPA requires liquids having more than 500 parts per million of poly-chlorinated biphenyls (PCBs) to be stored in DOT-17E drums, or equivalent sealed containers, and that those drums be stored in a diked area with an impervious and drainless floor. The diked area is provided by the spill pallet and must have a liquid-receiving volume equal to at least twice the volume of the largest container stored on the pallet.

U.S. Pat. No. 4,361,232, which issued to Olmsted on Nov. 30, 1982, is illustrative of a basic type of spill pallet developed in accordance with EPA requirements. In the Olmsted patent, an open-topped box comprising a solid bottom wall and a series of upstanding side walls serves as the spill pallet. The drums are carried or placed on the bottom wall of the spill pallet, and the pallet provides an available volume which is twice that of the largest container placed therein. The side walls are laterally unsupported, but do not tend to deform because they are not load bearing.

Spill pallets of the type disclosed in the Olmsted patent contain spills but, due to the fact that the side walls extend above the drum-supporting bottom, placement of drums within the pallet is difficult. Also, since the drums rest within the area intended for liquid containment or retention, the drums will be partially immersed in liquid should a leak or spill occur, making spill detection and clean-up more labor intensive and time consuming.

In response to the shortcomings of the basic spill pallet embodied by the Olmsted patent, a next generation of prior art spill pallet was developed by the assignee of the present invention. This prior art spill pallet, which is illustrated in FIGS. 1 and 2, supports the bottom of the drums vertically above the spill retention or containment area.

The prior art spill pallet 10 is shown to include a bottom wall 12 and a series of side walls 14. The sidewalls 14 cooperate to provide a rectangular peripheral ledge or rim 16. The bottom wall 12 has projecting upwardly therefrom an inner support 18 which is generally cross-shaped, as illustrated. The cross-shaped support 18 provides an upstanding ridge 20 and divides or separates the pallet into a series of four bowl-shaped recesses 22. The terminal ends 24 of the cross-shaped support 18 are spaced from the side walls 14 of the pallet 10. Fluid communication channels 26 are defined by the terminal ends 24 and the side walls 14 and provide a fluid communication path between adjacent bowl-shaped recesses 22.

A pair of drum-supporting grates (not shown) rest upon the upper surface of the cross-shaped support 18 and the rim 16. The grates are separated or spaced-apart by the ridge 20. Since the terminal ends 24 of the cross-shaped support 18 are spaced from the side walls 14, they provide no lateral support for the side walls 14 and the side walls tend to bulge or otherwise deform when loaded.

The spill pallet shown in FIGS. 1 and 2 addresses the disadvantages associated with the basic spill pallet illustrated in the Olmsted patent. However, the side walls 14 of the illustrated spill pallet, like its predecessors, are unsupported laterally. While this is not a disadvantage in the Olmsted spill pallet, since the side walls 14 of the illustrated prior art spill pallet are load bearing they have a tendency to deform. This potential instability may limit the load-bearing capability and useful life of the spill pallet illustrated in FIGS. 1 and 2. Therefore, there exists a need in the art for a spill pallet which spaces the drum-supporting surface upwardly from the spill containment and retention area while having a laterally supported, stable, load-bearing side wall structure.

SUMMARY OF THE INVENTION

The present invention is directed toward a laterally stable and supported spill pallet that provides a drum-supporting surface which is spaced from a spill containment and retention area. The spill pallet is adapted to support a plurality of drums, and includes a bottom wall, a series of side walls, and a grate.

In accordance with the present invention, the bottom wall has extending upwardly therefrom a central support member and a series of support rails. The central member and rails provide upper surfaces, a plurality of lateral surfaces, and a series of upstanding dividers. The upper surfaces are co-planar, and the lateral surfaces slope downwardly to the bottom wall. The dividers project from the upper surfaces of the rails and the central support member.

In further accordance with the present invention, the side walls include a rim. The rim encircles the perimeter of the spill pallet and is generally co-planar with the upper surfaces of the central member and the support rails. The support rails extend from the side walls toward the central support member and interconnect the side and bottom walls.

In further accordance with the present invention, the side walls, rails, and central support member cooperate to define a series of fluid-receiving chambers. The rails include a terminal surface which is spaced from the central member and slopes to the bottom wall. The central member and the terminal surfaces define fluid communication channels between adjacent chambers, thereby providing a fluid flow path between the chambers and allowing the spill pallet to receive a volume of liquid which is at least twice that of the largest container placed thereon.

The spill pallet in accordance with the present invention is a marked improvement over that shown in FIGS. 1 and 2. Specifically, the rated static load of the inventive spill pallet is approximately 6000 lbs., as compared to 4000 lbs. for the prior art pallet. The improved load-bearing capacity of the spill pallet produced in accordance with the present invention is provided even though the inventive spill pallet is manufactured with less plastic than the illustrated prior art pallet.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
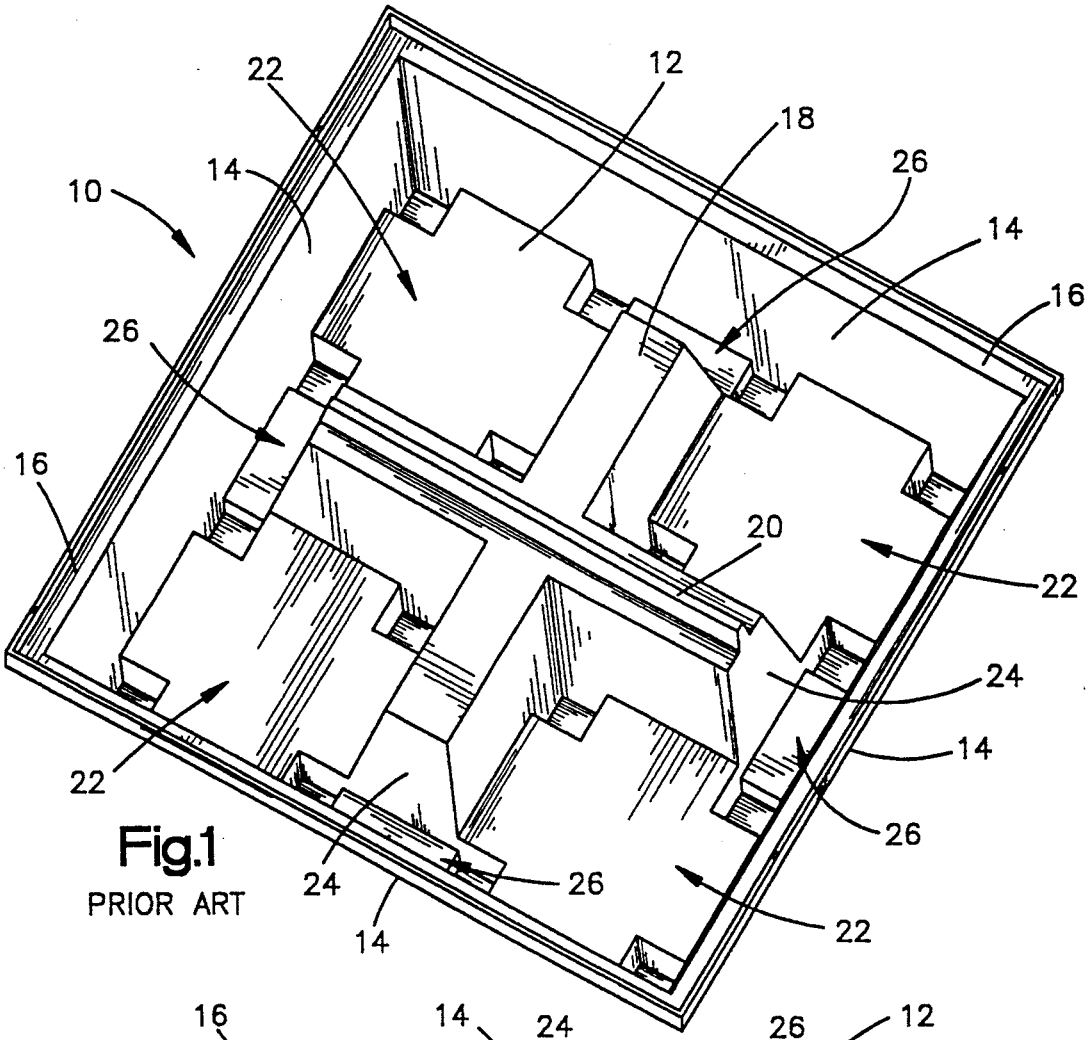
Fig.1 PRIOR ART
FIG. 1 is a perspective view of the previously discussed prior art spill pallet.
Figure 2:
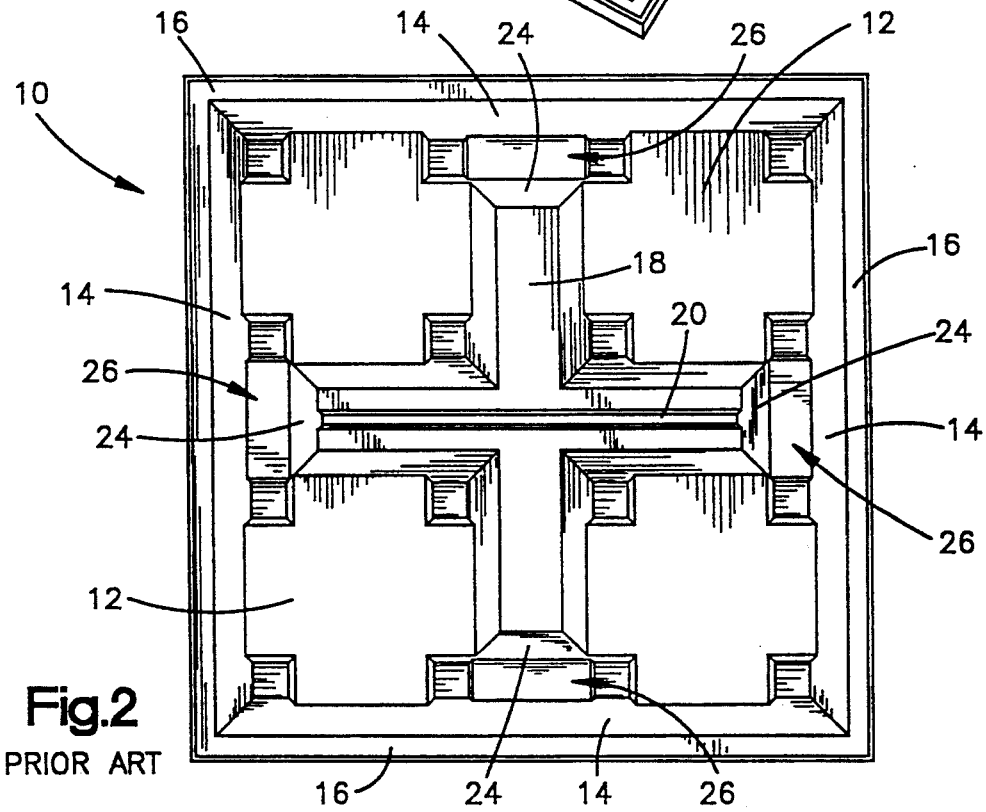
Fig.2 PRIOR ART
FIG. 2 is a top plan view of the previously discussed prior art spill pallet.
Figure 3:
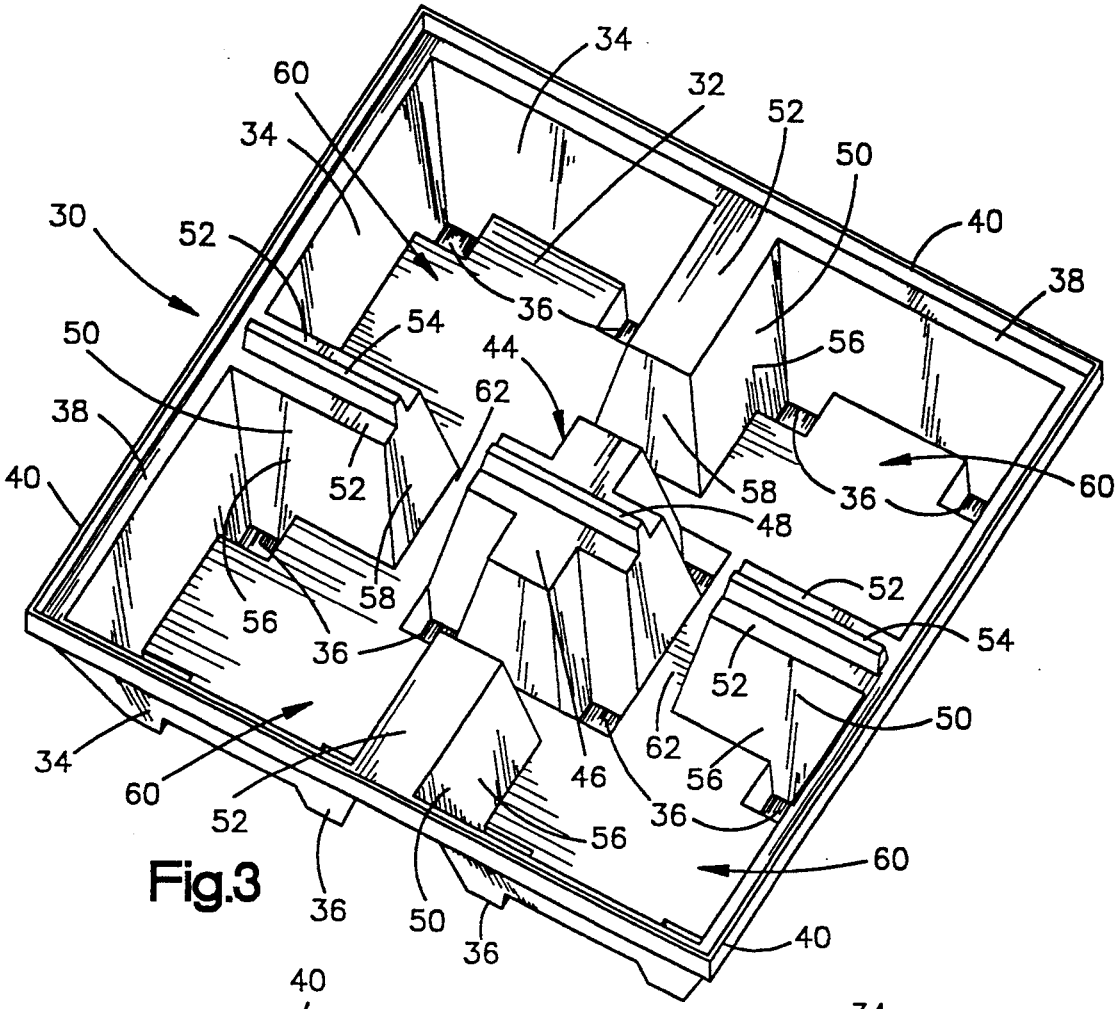
FIG. 3 is a perspective view of a spill pallet in accordance with the present invention.
Figure 4:
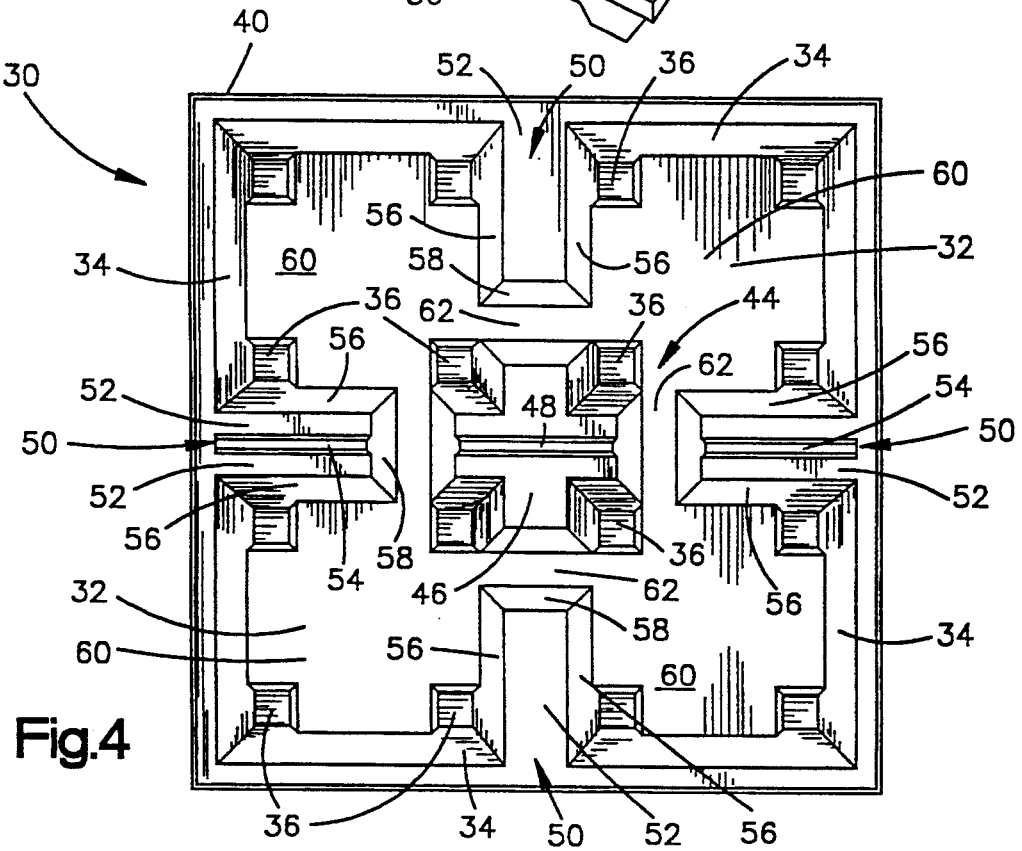
FIG. 4 is a top plan view of the spill pallet in accordance with the present invention.
Figure 5:
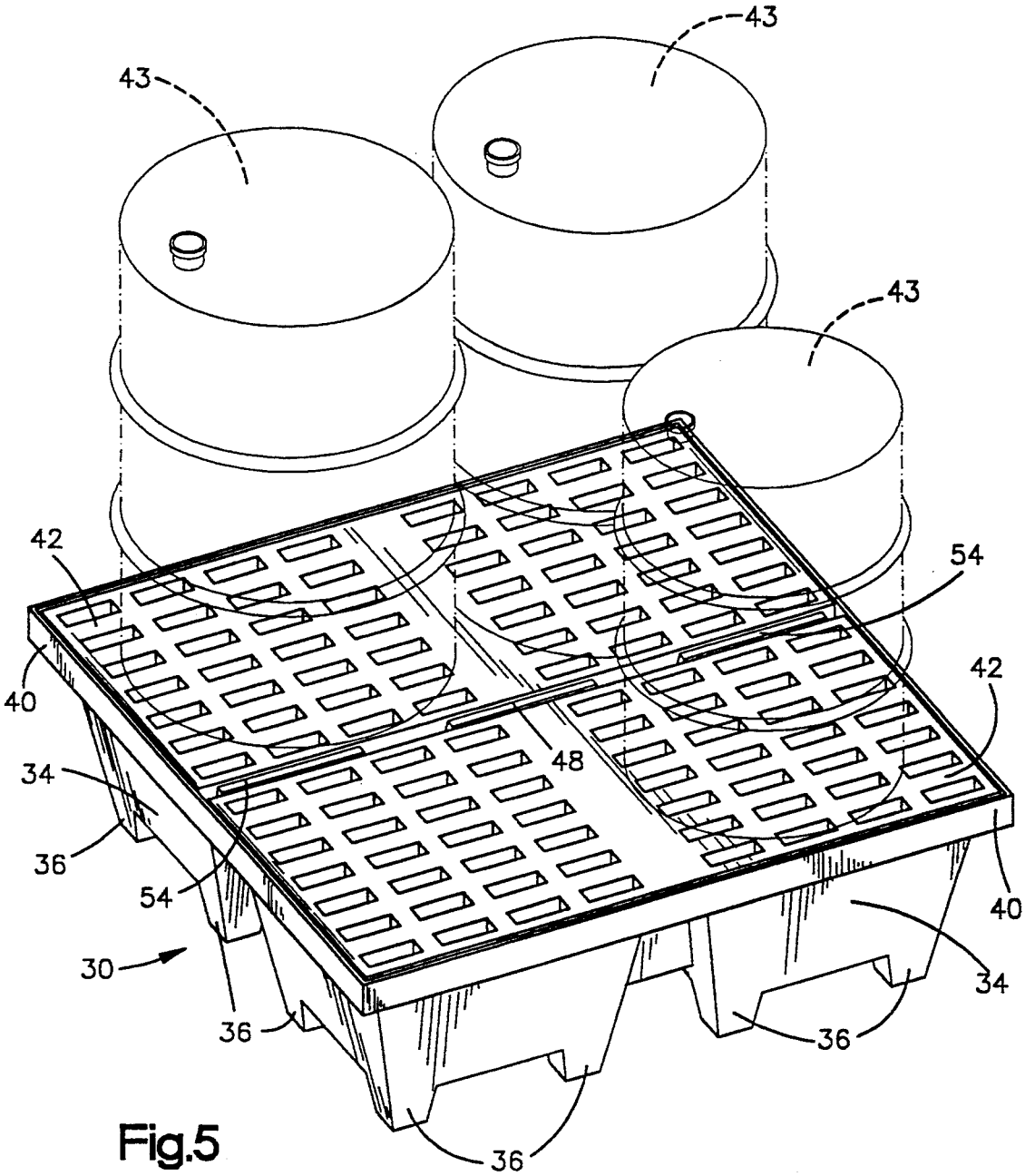
FIG. 5 is a perspective view of the spill pallet in accordance with the present invention with a grate thereon and a series of liquid-containing drums shown in phantom.

With reference to FIGS. 3–5, a spill pallet 30 according to the present invention is shown. The spill pallet 30 includes a bottom wall 32, upstanding side walls 34, and a series of downwardly-projecting feet 36. The feet 36 extend from the bottom wall 32, vertically supporting and spacing the bottom wall a short distance above the ground. Preferably, the feet 36 are arranged in a pattern which allows the pallet 30 to be lifted by a forklift (not shown) from any of the four sides of the pallet 30.

The side walls 34 extend above the bottom wall 32 and provide an inner peripheral ledge or rim 38 and an upstanding flange 40. The flange 40 projects slightly above and encircles the rim 38, and is designed to help retain a pair of grates 42 on the pallet 30 (FIG. 5). The grates 42 have an open structure to allow fluid to flow therethrough, and are designed to support a plurality of fluid containing vessels, such as drums 43.

The bottom wall 32 has extending upwardly therefrom a central support member 44. The central support member 44 has an upper supporting surface 46 from which projects a dividing rib or ridge 48. The ridge 48 is width-wise directed, as illustrated, and generally divides the pallet 30 in half.

The bottom wall 32 and side walls 34 have projecting upwardly and inwardly, respectively, therefrom a series of support rails 50. The support rails 50 extend generally from a mid point of each side wall 34 toward the central support member 44. Each rail 50 provides an upper supporting surface 52, and two of the rails 50 include a dividing rib or ridge 54. The rail dividing ridges 54 are generally in line with the central support member dividing ridge 48, and cooperate therewith to define first and second pallet portions.

The supporting surfaces 46 and 52 are co-planar with the rim 38 provided by the side walls 34 and cooperate therewith to vertically support the pair of grates 42. One grate 42 is provided for each of the first and second pallet portions. The grates 42 are separated by the upstanding ridges 48, 54 and laterally trapped between the ridges 48, 54 and the flange 40, as shown best in FIG. 5.

The rails 50 include a pair of lateral walls 56 and an inner terminal wall 58 which slope downwardly to the bottom wall 32. A series of fluid containment and retention chambers 60 are formed between the side walls 34 and the lateral walls 56 of the rails 50. The inner terminal walls 58 are spaced from the central support member 44 to define a series of fluid communication channels 62. The channels 62 allow fluid flow between adjacent chambers 60. Preferably, the available volume for fluid retention and containment provided by the present spill pallet 30 is at least twice the volume of each drum 43 placed thereon.

The rails 50 are integral with the side walls 34 and integrally link the side and bottom walls 34, 32. As such, the side walls 34 are laterally stable and resist the tendency to deform under the weight of the drums. Preferably, the spill pallet 30 is integrally molded from a non-chemically reactive material and, most preferably, that material is polyethylene.

While the preferred embodiment of the present invention is shown and described herein, it is to be understood that the same is not so limited but shall cover and include any and all modifications thereof which fall within the purview of the invention. For example, although the spill pallet is specifically shown to support four drums, it can be adapted to support any number of drums, and can be used with any other type of fluid containing vessels. Moreover, although the central support member and supporting rails are described herein as being integrally formed with the bottom and side walls, it is contemplated that the central support member and supporting rails could be separately formed and thereafter attached to the bottom and side walls.

What is claimed is:

1. A spill pallet for supporting a plurality of fluid containing vessels, said pallet having a bottom wall and a series of vertically-oriented side walls, said bottom wall cooperating with said side walls to define an open-topped box structure, said side walls providing a peripheral rim and said bottom wall having a central support member extending upwardly therefrom, a grate mounted on said central support member and having edges supported by said peripheral rim, a series of supporting rails also extending upwardly from said bottom wall and inwardly from said side walls toward the central support member to further support said grate, the rails interconnecting the side and bottom walls and laterally stiffening the side walls, a series of fluid-receiving chambers being bounded by the rails, central support member, and side walls, terminal ends of the rails being spaced from the central support member to define fluid communication channels which fluidly interconnect adjacent chambers.

2. A spill pallet according to claim 1, wherein the chambers and channels have a combined volume which is at least twice that of each containment vessel.

3. A spill pallet according to claim 2, wherein the rim, central support member, and rails cooperate to define a grate-supporting surface, said grate vertically supporting the vessels.

4. A spill pallet according to claim 1, wherein the rails have an upper surface, a pair of downwardly sloping lateral surfaces, and a downwardly sloping terminal surface, said downwardly sloping surfaces merging with the bottom wall.

5. A spill pallet according to claim 4, wherein the central support member comprises an upper surface and a series of downwardly sloping lateral surfaces, the upper surfaces of the rails and the central support member cooperating with the rim to define a grate-supporting surface.

6. A spill pallet according to claim 5, wherein the Chambers and channels have a combined volume which is at least twice that of each of the containment vessels.

7. A spill pallet for supporting a plurality of fluid containing vessels, said pallet comprising a bottom wall, a series of vertically upstanding walls, and a vessel supporting grate, said bottom wall cooperating with said side walls to define an open-topped box structure which is removably covered by the grate, said side walls providing a peripheral rim and said bottom wall having a central support member extending upwardly therefrom, a series of supporting rails extending upwardly from said bottom wall and inwardly from said side walls toward the central support member, said rim, central support member and rails having generally co-planar surfaces which cooperate to vertically engage and support said grate, said rails interconnecting the side and bottom walls and laterally stiffening the side walls, wherein a series of chambers are bounded by the rails, central support member, and side walls and terminal ends of the rails are spaced from the central support member to define fluid communication channels, said channels fluidly interconnecting adjacent chambers and cooperating with said chambers to define an available volume which is at least twice that of each containment vessel.

8. A spill pallet according to claim 7, wherein the rails have an upper surface, a pair of downwardly sloping lateral surfaces, and a downwardly sloping terminal surface, said downwardly sloping surfaces merging with the bottom-wall.

9. A spill pallet according to claim 8, wherein the central support member comprises an upper surface and a series of downwardly sloping lateral surfaces, said upper surfaces of the rails and the central support member being generally co-planar with the rim and supporting the grate.

* * * * *